US006592395B2

(12) United States Patent
Brown et al.

(10) Patent No.: US 6,592,395 B2
(45) Date of Patent: Jul. 15, 2003

(54) IN-LINE CABLE CONNECTOR ASSEMBLY

(75) Inventors: Reed Scott Brown, Indianapolis, IN (US); Robert H. Jackson, Grayson, GA (US); Ronald Kohl, Fishers, IN (US); Don Terry, Lawrenceville, GA (US); Perry K. White, Indianapolis, IN (US); Ronald L. Wild, Carmel, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/969,826

(22) Filed: Oct. 3, 2001

(65) Prior Publication Data

US 2003/0064622 A1 Apr. 3, 2003

(51) Int. Cl.[7] ..... H01R 4/24
(52) U.S. Cl. ..... 439/405; 439/941
(58) Field of Search ..... 439/404, 405, 439/941

(56) References Cited

U.S. PATENT DOCUMENTS 4,552,429 A * 11/1985 van Alst ..... 439/392
6,050,842 A 4/2000 Ferrill et al.
6,056,584 A 5/2000 Daoud
6,196,880 B1 3/2001 Goodrich et al.
6,371,794 B1 * 4/2002 Bauer et al. ..... 439/404

* cited by examiner

*Primary Examiner*—Renee Luebke
*Assistant Examiner*—Ann McCamey
(74) *Attorney, Agent, or Firm*—Thomas, Kayden, Horstemeyer & Risley, LLP

(57) ABSTRACT

A connector assembly for connecting wire leads of a first cable to corresponding wire leads of a second cable. A terminal housing structure has a first base, and a second base facing opposite to the first base. First pairs of connector terminals are configured to connect with pairs of wire leads of the first cable, and second pairs of connector terminals are configured to connect with pairs of wire leads of the second cable. A wiring board captured between the first and second bases has sets of conductive terminal openings at corresponding locations in the board. The first pairs of connector terminals are mounted on one side of the board in first pairs of terminal openings, and the second pairs of connector terminals are mounted on the opposite side of the board in second pairs of terminal openings which are electrically connected to the first pair of openings. The sets of terminal openings are spaced apart sufficiently to avoid cross-talk between the pairs of connector terminals.

9 Claims, 9 Drawing Sheets

IN-LINE CABLE CONNECTOR ASSEMBLY

BACKGROUND OF THE INVENTION

1. Field of the Invention

This invention relates to devices for connecting or splicing wire cables to one another.

2. Discussion of the Known Art

In-line devices for connecting or splicing two cables carrying pairs of twisted wire leads are generally known. In one such device, Radio Shack, #279-444, terminals of a modular plug on a first cable are electrically connected through eight parallel jackwires inside the device to corresponding terminals of a plug on a second cable.

U.S. Pat. No. 6,056,584 (May 2, 2000) discloses a dual-sided insulation displacement connector (IDC) block. The block has oppositely facing, electrically connected arrays of IDCs on both sides of the block. Each connector of one array is electrically connected to a matching connector of the other array via an internal metallic IDC terminal strip. U.S. Pat. No. 6,050,842 (Apr. 18, 2000) relates to an electrical connector with paired terminals for use with first and second wire pairs. Corresponding pairs of terminals of the connector are spaced closer together than terminals associated with different wire pairs, to reduce capacitive crosstalk between adjacent wire pairs.

A common problem with cable connecting devices, is that they tend to introduce crosstalk among signals carried over different pairs of cable wire leads which the devices interconnect. For a given connecting device, the level of crosstalk introduced b the device generally increases with the frequency of the disturbing signal. Thus, prior cable splice connectors which introduced little, if any, noticeable crosstalk at analog voice or low digital rate signal frequencies, may be unusable in high data rate applications such as Ethernet and other types of local area networks.

While techniques are known to reduce or to compensate for crosstalk introduced by certain kinds of cable plug connectors (see, e.g., U.S. Pat. No. 6,196,800 issued Mar. 6, 2001, and assigned to the assignee of the present invention and application), such techniques are effective only when the crosstalk being introduced is at a constant level or has a predictable value. If the level of offending crosstalk can not be predicted such as may occur, for example, when pairs of cable leads to be spliced together are dressed and connected at terminals of a connector device in random fashion by installers in the field, any crosstalk produced by the overall cable splice cannot be effectively compensated by any fixed scheme.

Accordingly, there is a need for an in-line cable connector or splice assembly that will produce negligible, if any, crosstalk among different signals that are carried by pairs of wire leads in the cables to be joined. An in-line connector capable of maintaining so-called Category 6 performance with respect to crosstalk loss is especially desirable in today's telecommunications environment. The Category 6 standard calls for at least 46 dB near-end crosstalk (NEXT) loss at 250 MHz.

SUMMARY OF THE INVENTION

According to the invention, a connector assembly for connecting wire leads of a first cable to corresponding wire leads of a second cable, includes a terminal housing structure having a first base, and a second base facing in a direction opposite the first base. First pairs of connector terminals are configured to connect with the first pairs of the wire leads, and second pairs of connector terminals are configured to connect with the second pairs of the wire leads. A wiring board is captured between the first and second bases of the housing structure, and the board has sets of four conductive terminal openings at corresponding locations in the board. The first pairs of connector terminals are mounted on one side of the board in corresponding first pairs of terminal openings, and the second pairs of connector terminals are mounted on the opposite side of the board in corresponding second pairs of terminal openings. The first and the second pairs of terminal openings are electrically connected to one another, so that a given pair of the first pairs of wire leads can be spliced to a corresponding pair of the second pairs of wire leads via the connector terminals associated with one of the sets of terminal openings in the wiring board. The terminal openings are spaced apart sufficiently to avoid cross-talk between connector terminals mounted in adjacent sets of the terminal openings.

For a better understanding of the invention, reference is made to the following description taken in conjunction with the accompanying drawing and the appended claims.

DETAILED DESCRIPTION OF THE INVENTION

Figure 1:
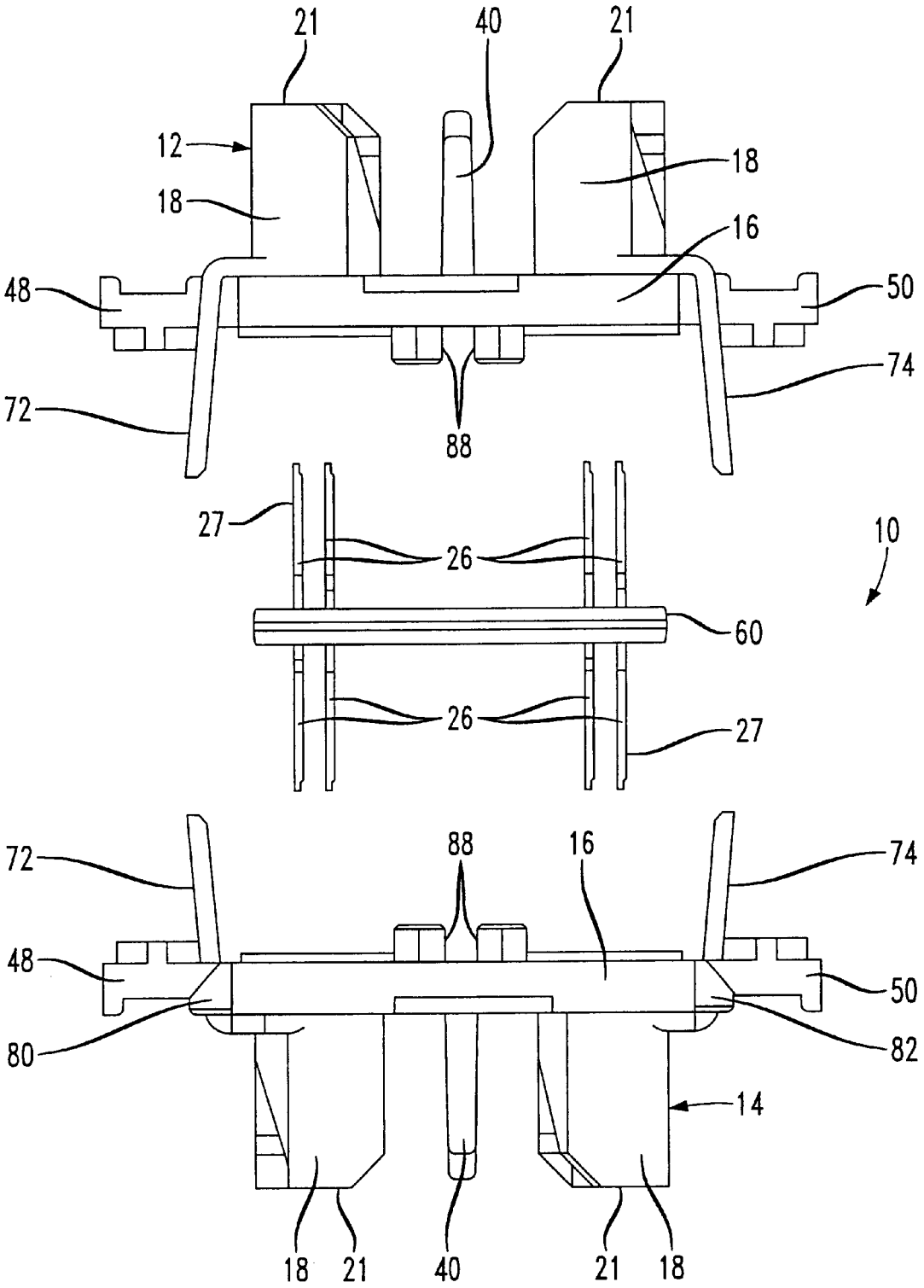
FIG. 1 is a side, exploded view of a first embodiment of a cable connector assembly according to the invention.

FIG. 1 shows a cable connector assembly 10 according to a first embodiment of the invention. The assembly 10 includes first and second terminal housing parts 12, 14. The housing parts 12, 14 may be formed substantially identical to one another such as, e.g., by molding of an insulative plastics material that meets applicable standards with respect to electrical insulation and flammability. Such materials include but are not limited to, polycarbonate, ABS, and blends thereof.

Figure 2:
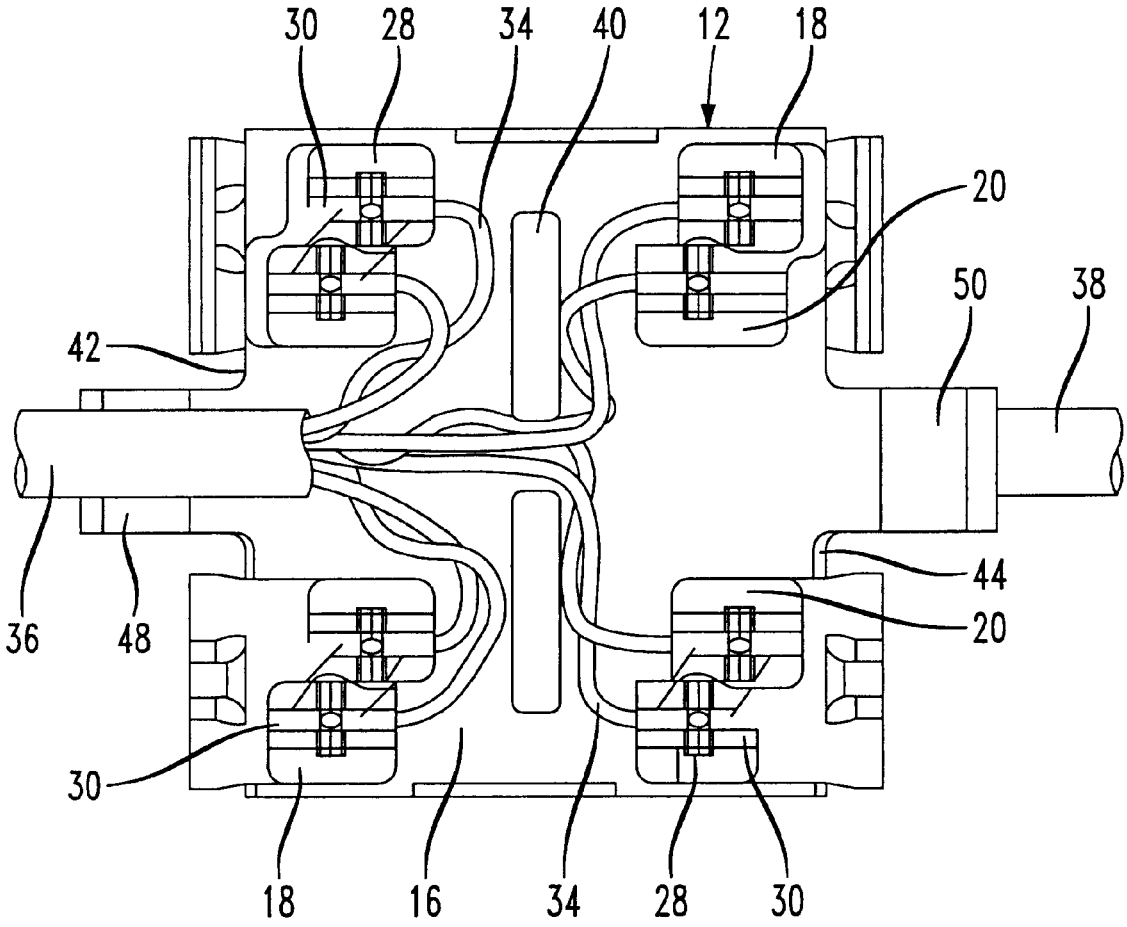
FIG. 2 is a top view of the first embodiment of FIG. 1.
Figure 3:
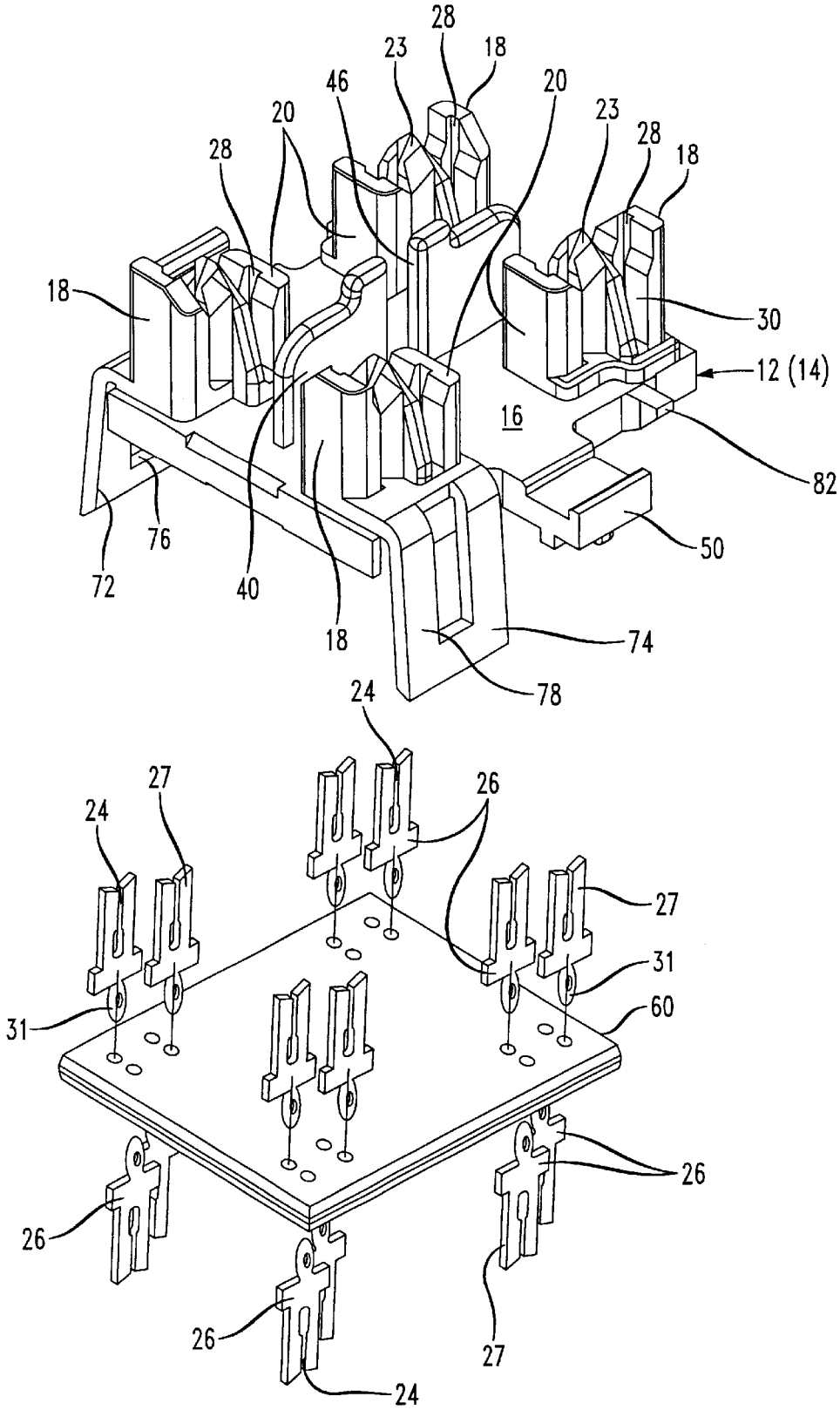
FIG. 3 is a perspective, assembly view of parts of the first embodiment of FIG. 1.

Each of the terminal housing parts 12, 14 has a generally rectangular base 16, and a pair of terminal guards 18, 20 at each of four corners of the base 16, as seen in FIGS. 2 and 3. The terminal guards extend upward from the base 16 and form corresponding vertical channels 28 within each of the guards 18, 20. The channels 28 pass through and open beneath the base 16 of each terminal housing part 12, 14.

The channels 28 are dimensioned to receive wire connecting portions 27 of individual insulation displacement connector (IDC) terminals 26. See FIG. 7 which is an enlarged view of the lower right-hand corner of the base 16 in FIG. 2.

As shown in FIGS. 1 and 3, uppermost portions of the terminal guards 18, 20 on each base 16 are formed with co-planar flats 21. The flats 21 allow the tops of the terminal guards 18, 20 on one of the housing parts to be placed against a stationary flat work surface, while performing so-called "punchdown" terminations of insulated wire leads into the terminals 26 associated with the terminal guards on the oppositely facing housing part. Thus, the flats 21 help to distribute shock during punchdown operations, and to protect pointed tips 23 formed on lower portions of the guards 18, 20 for the purpose of splitting twisted wire lead pairs to be terminated.

Figure 7:
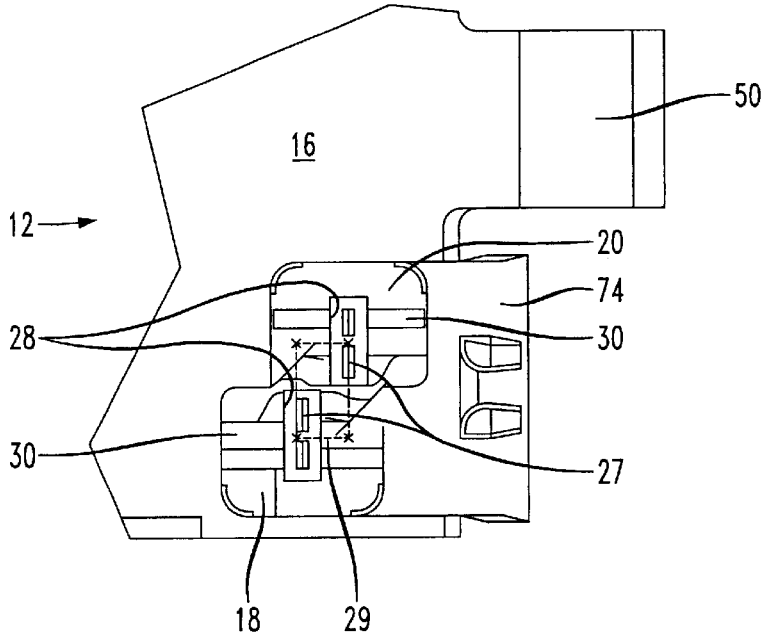
FIG. 7 is an enlarged view of a corner portion of the connector assembly of the first embodiment in FIG. 2.

Pairs of the terminal guards 18, 20 on each housing part are located so that centers of the channels 28 define diagonally opposite corners of a rectangular array 29, as represented in FIG. 7. In the illustrated embodiment, the array 29 measures, e.g., 0.056 inches wide by 0.105 inches high as oriented in the drawing. Each of the terminal guards 18, 20 also forms a vertical groove 30 that extends upward from the base 16 and coincides with an insulation cutting groove 24 (FIG. 3) in the IDC terminals when received in the guard channels 28. In the illustrated embodiment, the IDC terminals 26 have "needle-eye" mounting parts or tails 31 configured to be press-fit into conductive plated terminal openings in a printed wiring board 60, described later below. The terminals 26 may correspond to those disclosed in U.S. Pat. No. 5,975,919 (Nov. 2, 1999) and U.S. Pat. No. 6,093,048 (Jul. 25, 2000) both of which are assigned to the assignee of the present application. All relevant portions of the '919 and the '048 U.S. Patents are incorporated by reference.

In FIG. 2, insulated, twisted pairs of wire leads 34 from a first cable end 36 are "punched" downward by a suitable tool (not shown) in the grooves 30 of corresponding terminal guards 18, 20 on the first housing part 12, and into the cutting grooves 24 in the associated IDC terminals 26. Insulation surrounding each lead 34 is displaced so that the lead makes electrical contact with the associated IDC terminal 26. In the illustrated embodiment, the cable end 36 carries four pairs of twisted wire leads as is typical for an eight-conductor data network cable. A second cable end 38, having pairs of wire leads to be spliced to corresponding wire lead pairs of the first cable end 36, has its wire leads (not shown) electrically connected to IDC terminals 26 within the guards 18, 20 on the second terminal housing part 14.

Each of the housing parts 12, 14 also has a vertical partition wall 40 extending upward and medially of opposite sides 42, 44 of its base 16. See FIG. 2. The partition wall 40 has a vertical slot 46 the axis of which coincides substantially with the center of the base 16. The partition wall 40 serves to control or contain lead dress among pairs of the wire leads 34 that terminate at the pairs of terminal guards 18, 20 at each corner of the housing parts 12, 14. Specifically, the wall 40 separates pairs of leads terminated at guards on side 42 of each base 16, from remaining pairs of leads which are dressed through the slot 46 and are terminated at guards on the opposite side 44 of each base 16.

Each of the terminal housing parts 12, 14 also has a pair of cable support tabs 48, 50 that project from the opposite sides 42, 44 of the base 16. When the housing parts 12, 14 are joined to one another as described below, the mutually facing support tabs on the two housing parts adjoin one another and act to support the corresponding cable ends 36, 38. The cable ends are preferably fixed to the support tabs 48, 50 by way of, e.g., conventional cable ties (not shown). Thus, movement of the wire leads 34 at the cable ends is restrained with respect to the base 16 of each housing part 12, 14.

Figure 4:
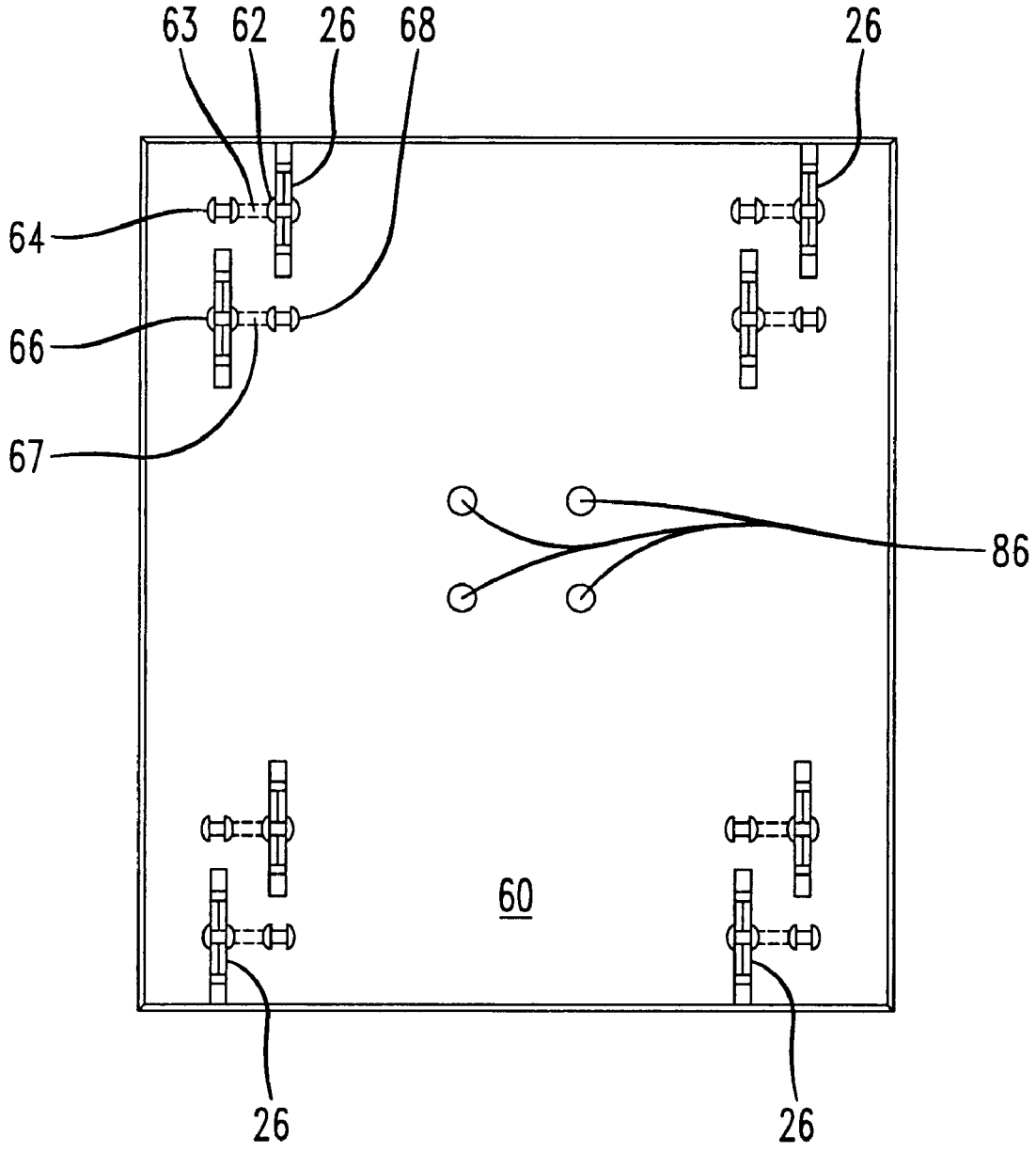
FIG. 4 is a plan view of a printed wiring board in the first embodiment.
Figure 8:
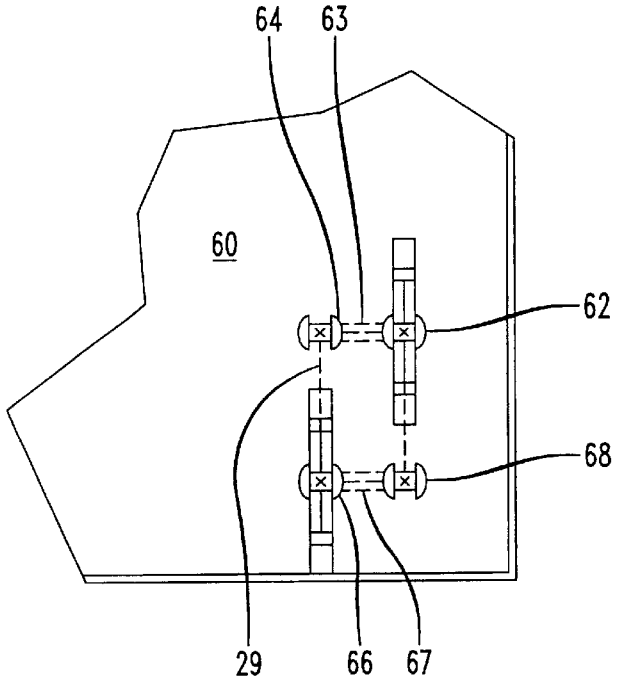
FIG. 8 is an enlarged view of a corner portion of the printed wiring board in FIG. 4.

The connector assembly 10 of the first embodiment also includes a rectangular printed wiring board 60 that is captured between the housing parts 12, 14 when the latter are joined to one another. Further details of the wiring board 60 are shown in FIGS. 4 and 8. The wiring board 60 has a set of four plated terminal openings 62, 64, 66, 68 at each corner of the board 60. The centers of the openings of each set correspond to the corners of the earlier mentioned rectangular array 29, as represented in FIG. 8. Thus, as seen in FIGS. 7 and 8, each set of four terminal openings 62, 64, 66, 68 in the board 60 is located to register with the centers of the channels 28 of corresponding terminal guards at each corner of the housing parts 12, 14, when the board 60 is sandwiched between the bases of the housing parts (FIG. 1). Also, at each set of terminal openings, terminal opening 62 is connected by a wire trace 63 on or within the board 60 to terminal opening 64, and terminal opening 66 is connected by a wire trace 67 to terminal opening 68.

Each of the four sets of terminal openings is spaced sufficiently from the other sets to avoid producing crosstalk between connector terminals mounted in one set of terminal openings, and connector terminals mounted in any of the three remaining sets of terminal openings. For example, a distance of at least about 0.450 inches between the closest terminals of each adjacent set of terminals was found sufficient to meet Category 6 performance with respect to minimum crosstalk loss.

Performance of the connector assembly 10 is also enhanced due to the fact that the overall lengths of the pairs of wire leads to be spliced from both cable ends 36, 38, are kept substantially equal. That is, as viewed in FIG. 2, shorter pairs of leads 34 from cable end 36 which terminate at the guards at the left side of the assembly, are spliced to corresponding longer pairs of leads from the cable end 38. Further, longer pairs of leads 34 from the cable end 36 which terminate at the guards at the right side of the assembly, are spliced to corresponding shorter pairs of leads from the cable end 38.

As seen in the drawing, one pair of IDC terminals 26 are mounted at each corner and on both sides of the board 60. Specifically, on the side of the board visible in FIGS. 4 and 8, a pair of terminals 26 are mounted at each corner in terminal openings 62 and 66. On the opposite of the board, another pair of terminals 26 are mounted at each corner in terminal openings 64 and 68. Also, as mentioned, terminal opening 62 is electrically connected to terminal opening 64, and terminal opening 66 is connected to terminal opening 68. Thus, the terminal mounted in terminal opening 62 on the side of the wiring board 60 shown in FIG. 4, is connected by the wire trace 63 to a corresponding terminal mounted on the opposite of the board in terminal opening 64. Further, the terminal mounted in terminal opening 66 on the side of the board shown in FIG. 4, is connected to a corresponding terminal mounted in terminal opening 68 on the opposite side of the board 60. Thus, each pair of terminals 26 mounted at a corner on one side of the board 60, is electrically connected via relatively short wire traces to a corresponding pair of terminals mounted at the same corner and on the opposite side of the board.

As seen in FIGS. 1 and 3, each of the terminal housing parts 12, 14 also has a pair of locking tabs 72, 74 that project downward from the base 16 near two corners of the base which are on the same side of the cable support tabs 48, 50. The locking tabs 72, 74 have apertures 76, 78 for receiving corresponding protuberances 80, 82 which are formed on the bases 16 on the side of the support tabs opposite the locking tabs 72, 74. The apertures 76, 78 and the protuberances 80, 82 are dimensioned and located so that, when the bases 16 of the housing parts 12, 14 face one another with the wiring board 60 aligned between them as in FIG. 1, and the terminals 26 mounted on both sides of the board are received in corresponding channels 28 of the terminal guards, the locking tabs 72, 74 on either one of the bases 16 can be deflected outward to clear the protuberances 80, 82 on the other one of the bases 16. The protuberances 80, 82 then snap into the apertures 76, 78 of the tabs 72, 74. The two housing parts 12, 14 thus become locked to one another with the terminals 26 on the printed wiring board extending within the terminal guards 18, 20 above the bases 16 of the housing parts, and with the cable support tabs 48, 50 on each side of the housing parts adjoining one another.

To ensure proper alignment of the terminals 26 on the wiring board 60 with the channels 28 in the pairs of terminal guards 18, 20 at the corners of each housing part 12, 14, the board 60 may have a number of holes 86 located in the board to register with corresponding locating pins 88 that project from beneath the bases 16. See FIGS. 1 and 4.

Figure 5:
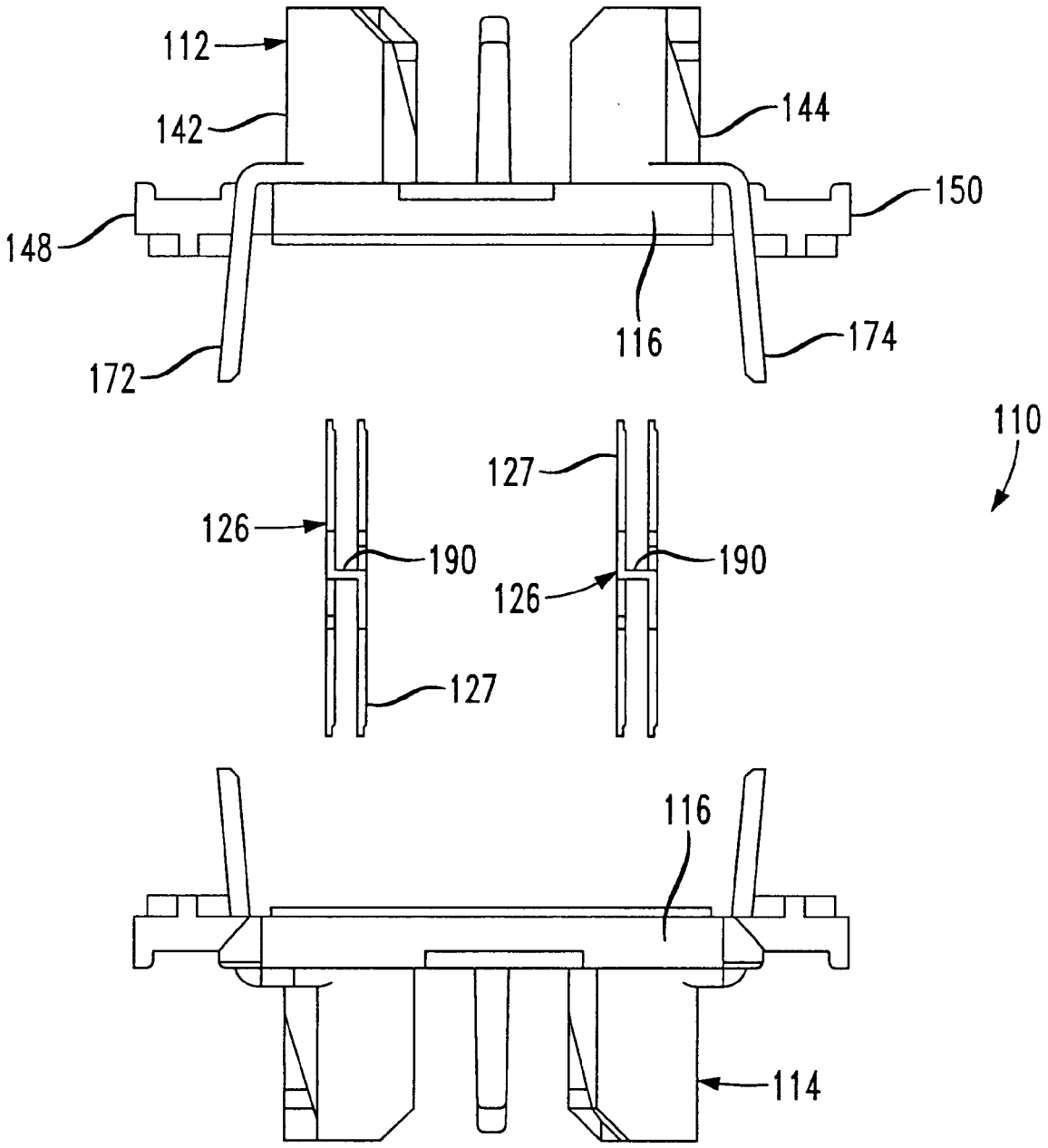
FIG. 5 is a side, exploded view of a second embodiment of a cable connector assembly according to the invention.
Figure 6:
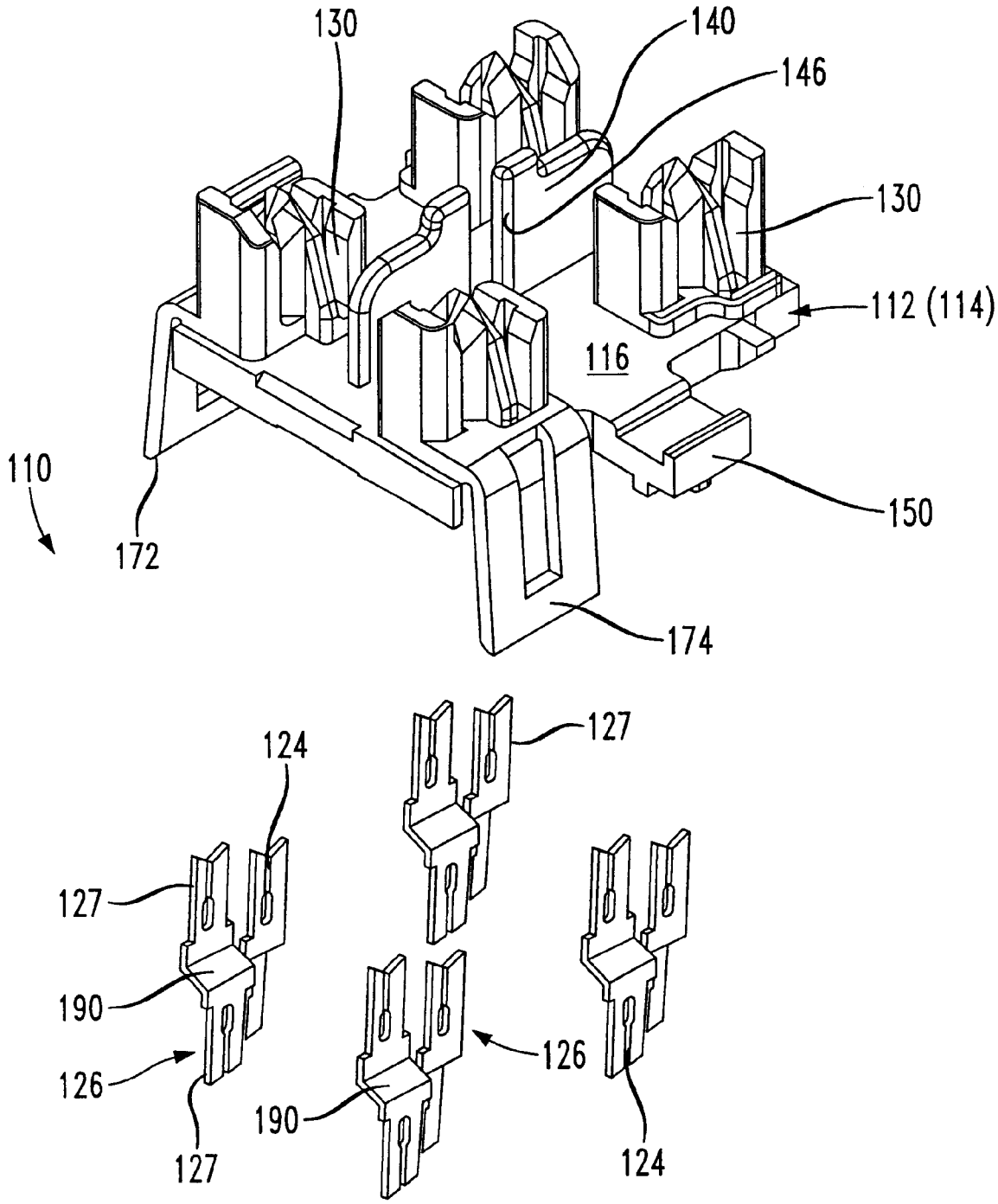
FIG. 6 is a perspective, assembly view of parts of the second embodiment of FIG. 5.

FIGS. 5 and 6 show a second embodiment of a cable connector assembly 110 according to the invention. Parts the same or similar to those of the first embodiment of FIGS. 1–4, have corresponding reference numerals increased by 100. The assembly 110 includes two terminal housing parts 112, 114. The housing parts 112, 114 may be formed substantially identical to one another, for example, by molding of an insulative plastics material such as polycarbonate, ABS, or blends thereof.

Each of the housing parts 112, 114 has a generally rectangular base 116, and a pair of terminal guards 118, 120 at each of four corners of the base 116. Vertical channels 128 formed within each of the guards 118, 120 pass through and open beneath the base 116 of each housing part. The channels 128 are dimensioned to receive wire connecting portions 127 of individual, double-ended insulation displacement connector (IDC) terminals 126, and the pairs of guards 118, 120 on each housing are located so that centers of the channels 128 define diagonally opposite corners of a rectangular array similar to the first embodiment. Each of the terminal guards 118, 120 also forms a vertical groove 130 (FIG. 6) that extends up from the base 116 to coincide with an insulation cutting groove 124 in the wire connecting portion 127 of each IDC terminal when received in the guard channel 128.

Each of the housing parts 112, 114 also has a vertical partition wall 140 extending upward and medially of opposite sides 142, 144 of its base 116, wherein the wall 140 has a vertical slot 146 through which pairs of wire leads from a cable end at one side of the wall 140, may be dressed to terminate at terminal guards 118, 120 on the opposite side of the wall 140. Also, as in the first embodiment, the terminal housing parts 112, 114 have a pair of cable support tabs 148, 150 projecting from opposite sides of the base 116; a pair of locking tabs 172, 174 projecting downward from the base 116 near two corners of the base and on the same side of cable support tabs 148, 150; and a pair of protuberances 180, 182 on each base 116 on the side of the support tabs opposite the locking tabs 172, 174. The locking tabs and the protuberances on the terminal housings 112, 114 cooperate to lock the two housings to one another, similar to the first embodiment.

The second embodiment of FIGS. 5–6 differs from the first embodiment of FIGS. 1–4, however, in the use of the double-ended connector terminals 126, and the absence of a printed wiring board for mounting of the connector terminals. As seen in FIGS. 5 and 6, each of the terminals 126 has two oppositely directed wire connecting portions 127 which are electrically connected via an integral jog or step 190 formed intermediate the wire connecting portions of the terminal. Thus, when the bases 116 of the terminal housing parts 112, 114 face one another as seen in FIG. 5 and the wire connecting portions of the terminals 126 are received in corresponding channels 128 in the terminal guards, the two housing parts may be locked to one another as in the first embodiment with the connector terminals 126 extending within the terminal guards 118, 120 above the bases 116 of each of the terminal housing parts 112, 114. The cable support tabs 148, 150 on each side of the housing parts adjoin one another to support two cable ends having pairs of wire leads to be spliced, as in the first embodiment. With the steps 190 captured between the bases 116 of the housing parts 112, 114, any displacement or disturbance of a first termination at one end of the terminal 126 while terminating a wire lead to the other end of the same terminal 126, is avoided.

Figure 9:
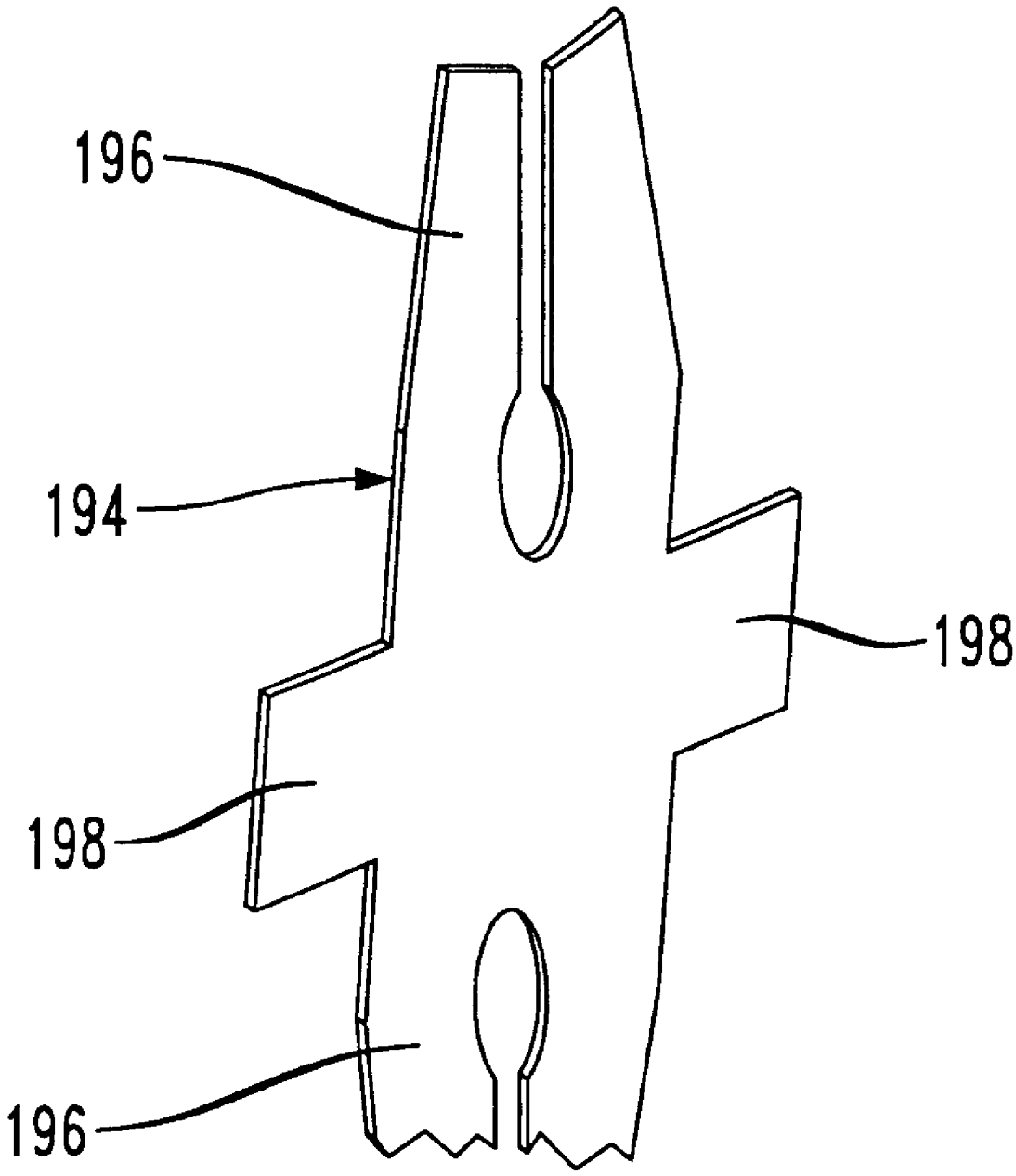
FIG. 9 shows a connector terminal that may be used in an alternate form of the second embodiment of FIGS. 5 and 6.

The step or jog 190 formed in each of the double-ended connector terminals 126 may also be eliminated and the terminal formed substantially flat. See, for example, double-ended connector terminal 194 in FIG. 9. In such case, the terminal guards 118, 120 at each corner of the housing parts 112, 114 must be located so that both wire connecting portions 196 on each connector terminal 194 will be received in corresponding channels 128 of the terminal guards on both housing parts when joined. Each terminal 196 may be captured within the housing parts 112, 114 by way of a pair of side ears 198 that are formed to project outward to either side of the bases of the connecting portions 196.

Further, in either of the two disclosed embodiments, it may be desirable to introduce a determined amount of capacitive and inductive coupling between those pairs of connector terminals that splice the corresponding cable-lead pairs to one another. Such coupling may ensure a proper impedance match (for example, 100 ohms) between the pairs of terminals and the pairs of wire leads connected to the terminals, thus avoiding any crosstalk that might be produced by an improper impedance match. The steps 190 in the connector terminals 126 of the second embodiment, may also be dimensioned and arranged to introduce such coupling through each pair of connector terminals.

Moreover, instead of using two identical interlocking housing parts 12, 14 or 112, 114 as in the disclosed embodiments, a unitary housing including the oppositely facing pairs of terminal guards 18, 20 or 118, 120 may be formed, e.g., by a suitable molding process about the connector terminals 26 as mounted on the wiring board 60, or about the double ended connector terminals 126 once the latter are appropriately positioned.

In the first embodiment of FIGS. 1–4, the overall size or footprint of the connector assembly 10 may be reduced if necessary to meet a certain application, until the pairs of connector terminals 26 at the corners of the assembly are spaced closer than a minimum distance needed to avoid crosstalk. In any case, one or more stages of crosstalk compensation may then be provided in a known manner on or within the wiring board 60.

While the foregoing description represents preferred embodiments of the invention, it will be obvious to those skilled in the art that various changes and modifications may be made without departing from the spirit and scope of the invention pointed out by the following claims.

Figure 10:
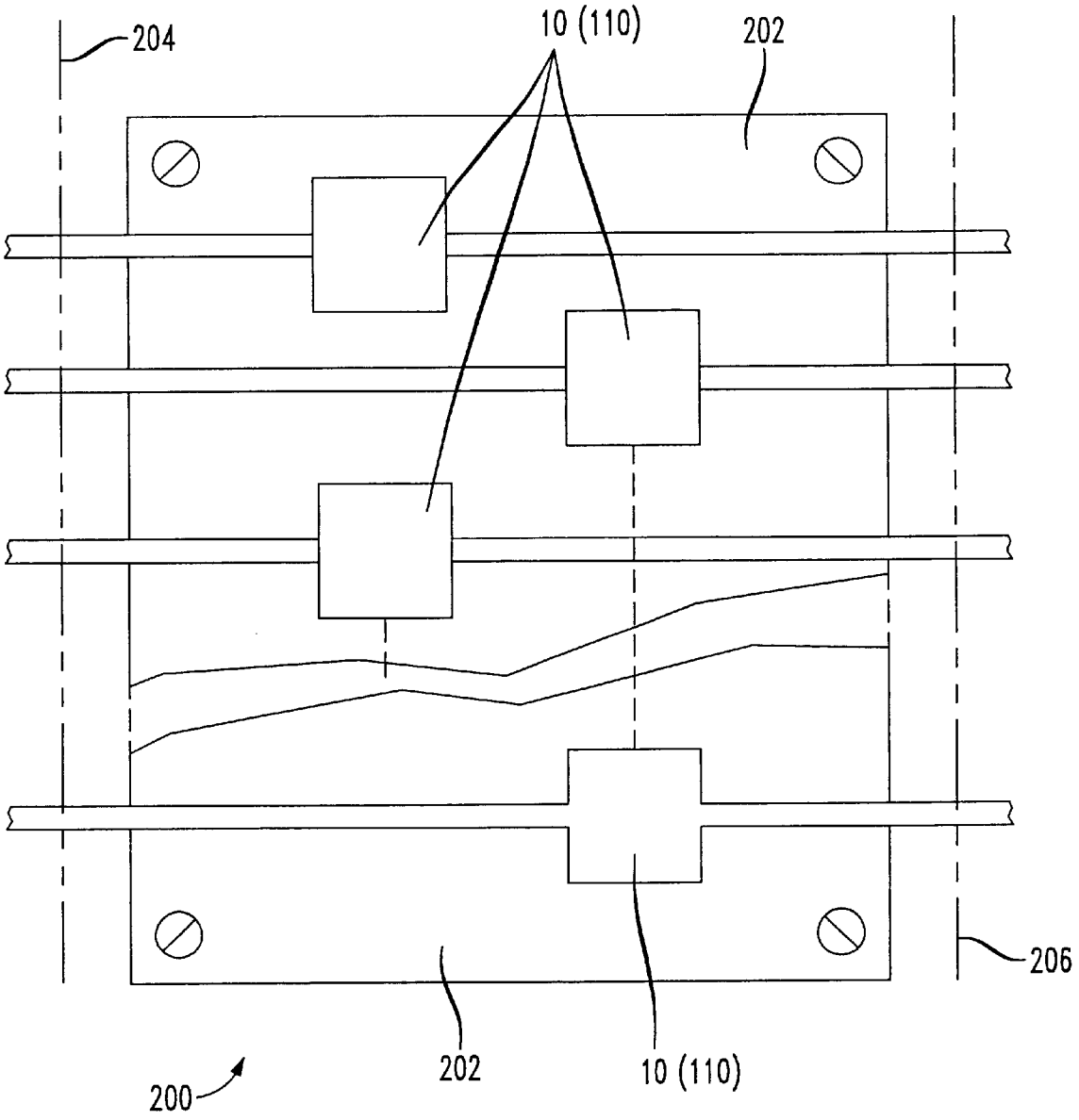
FIG. 10 is a block diagram showing an array of cable connector assemblies according to the invention.

For example, as shown in FIG. 10, a number of the present connector assemblies 10 (or 110) may be supported in an array 200 on a common mounting base 202, for use on walls or in distribution boxes. A corresponding number of input and output cables may then be spliced to one another by offsetting the relative positions of the assemblies to allow the input and the output cables to be aligned with one another between an input side 204 and an output side 206 of the array 200.

We claim:

1. A connector assembly for connecting first pairs of wire leads for a first cable to corresponding second pairs of wire leads of a second cable, comprising:

a terminal housing structure comprising first and second terminal housing parts which are substantially identical to each other and comprise a first base on said first part, and a second base on said second part facing in a direction opposite the first base said parts being latched together;

first pairs of connector terminals configured to connect with the first pairs of wire leads of the first cable;

second pairs of connector terminals configured to connect with the second pairs of wire leads of the second cable;

a wiring board captured between the first and the second bases of the terminal housing structure, wherein the wiring board has sets of four spaced conductive terminal openings formed at locations in the board corresponding to the connector terminal location, the first pairs of connector terminals are mounted on one side of the board in corresponding first pairs of terminal openings of each set, the second pairs of connector terminals are mounted on the opposite side of the board in corresponding second pairs of terminal openings of each set, and conductors are arranged to connect the first and the second pairs of the terminal openings within each set to one another;

wherein a given pair of the first pairs of wire leads can be spliced to a corresponding pair of the second pairs of wire leads via the connector terminals associated with one of the sets of terminals in the wire board;

a partition wall extending upwardly and medially from each of said bases to separate at least one of said pairs of conductor terminals from another one of said pairs of conductor terminals wherein said wall is dimensional to coating and control lead dress among the first and second pairs of wire leads; and the sets of terminal openings are spaced apart sufficiently from one another to avoid crosstalk between the connector terminals mounted in adjacent sets of terminal openings.

2. A connector assembly according to claim 1, wherein at least some of the connector terminals are insulation displacement connector (IDC) terminals.

3. A connector assembly according to claim 1, wherein the partition wall has a vertical slot, and the axis of the slot coincides substantially with the center of each of the first and second bases.

4. A connector assembly according to claim 1, wherein the wiring board is generally rectangular in shape having first, second, third, and fourth corners, the first two pairs of connector terminals are disposed on one side of the wiring board in the vicinity of the first and second corners of the wiring board, and the second two pairs of connector terminals are disposed on the opposite side of the wiring board in the vicinity of third and fourth corners of the wiring board and said partition wall extends between said first two pairs of connector terminals and said second two pairs.

5. A connector assembly according to claim 1, wherein pairs of the connector terminals which are arranged to connect with the pairs of the wire leads of the first and the second cables, are coupled to one another to provide an impedance match with said pairs of wire leads.

6. A connector assembly as claimed in claim 1 including fastening members associated with the first and the second terminal housing parts for joining the terminal housing parts to form said terminal housing structure.

7. A connector assembly according to claim 6, wherein each of the terminal housing parts is formed with a first pair of said fastening members and a second pair of said fastening members, and the first pair of fastening members on one terminal housing part are configured to engage the second pair of fastening members on the other terminal housing part when the housing parts are joined to one another.

8. A connector assembly according to claim 1, wherein the terminal housing structure includes terminal guards extending upward from each of the first and second bases, and the terminal guards have vertical channels that open through the bases to receive a wire-connecting portion of each of the first and the second pairs of connector terminals.

9. A connector assembly according to claim 8, wherein at least some of the connector terminals are IDC terminals having insulation cutting grooves, and the terminal guards have vertical grooves formed to coincide with the insulation cutting grooves of the IDC terminals received in the guards so that the pairs of wire leads of the first and second cables can be drawn down in the grooves of the terminal guards and connect electrically to the IDC terminals in the guards.

* * * * *